US005575088A

United States Patent [19]

Allen et al.

[11] Patent Number: 5,575,088

[45] Date of Patent: Nov. 19, 1996

[54] SHOE SOLE WITH REACTIVE ENERGY FLUID FILLED TOROID APPARATUS

[75] Inventors: Bernie Allen, Wayland, Mass.; Christopher J. Edington, Derry, N.H.; Rui Parracho, Peabody, Mass.; Douglas E. Clark, Amesbury, Mass.; Eric S. Swartz, Malden, Mass.

[73] Assignee: Converse Inc., North Reading, Mass.

[21] Appl. No.: 431,627

[22] Filed: May 1, 1995

Related U.S. Application Data

[63] Continuation of Ser. No. 767,132, Sep. 27, 1991, abandoned.

[51] Int. Cl.[6] ..... A43B 13/18; A43B 19/00; A43B 7/14

[52] U.S. Cl. ..... 36/28; 36/153; 36/71

[58] Field of Search ..... 36/71, 43, 28, 36/29, 88, 3 R, 3 B, 37, 38, 27, 34 R, 35 R, 153; 5/448, 455, 480; D2/961

[56] References Cited

U.S. PATENT DOCUMENTS

| | | | |
|---|---|---|---|
| D. 268,303 | 3/1983 | Gaski | D2/318 |
| D. 300,687 | 4/1989 | Kelley | D2/961 |
| D. 302,764 | 8/1989 | Peoples et al. | D2/961 |
| D. 308,901 | 7/1990 | Hase | D2/314 |
| 545,705 | 9/1895 | MacDonald | 36/29 X |
| 2,365,027 | 12/1944 | Urbany | 36/29 |
| 3,267,592 | 9/1966 | Champion | 36/35 |
| 4,075,772 | 2/1978 | Sicurella | 36/43 |
| 4,115,934 | 9/1978 | Hall | 36/44 |
| 4,123,855 | 11/1978 | Thedford | 36/44 |
| 4,219,945 | 9/1980 | Rudy | 36/29 |
| 4,223,457 | 7/1980 | Borgeas | 36/35 B |
| 4,342,158 | 8/1982 | McMahon et al. | 36/35 R |
| 4,358,902 | 11/1982 | Cole et al. | 36/28 |
| 4,445,240 | 5/1984 | Voorhees | 5/455 X |
| 4,471,538 | 9/1984 | Pomeranz et al. | 36/28 |
| 4,521,979 | 6/1985 | Blaser | 36/28 X |
| 4,737,999 | 4/1988 | Halverson | 5/455 |
| 4,779,359 | 10/1988 | Famolare, Jr. | 36/29 |
| 4,819,287 | 4/1989 | Halverson | 5/455 |
| 4,843,735 | 7/1989 | Nakanishi | 36/134 X |
| 4,845,863 | 7/1989 | Yung-Mao | 36/114 |
| 4,852,274 | 8/1989 | Wilson | 36/28 X |
| 4,918,838 | 4/1990 | Chang | 36/28 |
| 4,918,841 | 4/1990 | Turner et al. | 36/28 X |
| 4,936,029 | 6/1990 | Rudy | 36/29 |
| 4,991,317 | 2/1991 | Lakic | 36/44 |
| 5,003,653 | 4/1991 | Mar | 5/455 X |
| 5,025,575 | 6/1991 | Lakic | 36/44 |
| 5,067,255 | 11/1991 | Hutcheson | 36/28 X |
| 5,070,559 | 12/1991 | Pettifer | 5/455 |
| 5,131,174 | 7/1992 | Drew et al. | 36/29 X |
| 5,175,946 | 1/1993 | Tsai | 36/29 |

FOREIGN PATENT DOCUMENTS

| | | | |
|---|---|---|---|
| 145300 | 11/1990 | Taiwan . | |
| 184346 | 5/1992 | Taiwan | 36/29 |

*Primary Examiner*—B. Dayoan
*Attorney, Agent, or Firm*—Howell & Haferkamp, L.C.

[57] ABSTRACT

A Reactive Energy Fluid Filled Toroid Apparatus includes concentric fluid filled toroids that are contained in the midsole of a shoe. The toroid apparatus provides cushioning for the foot and dynamically reacts to off-center impacts from footsteps to redistribute impact forces and to stabilize and support the foot by cradling a portion of the foot in the shoe.

15 Claims, 1 Drawing Sheet

FIG. 1.
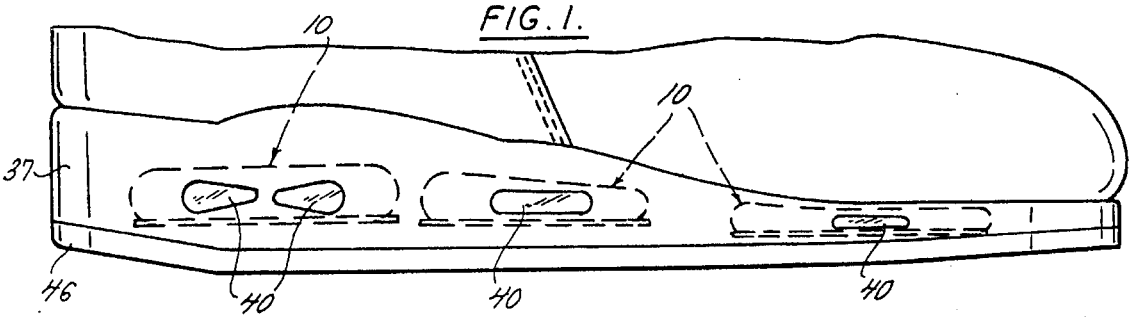
FIG. 2.
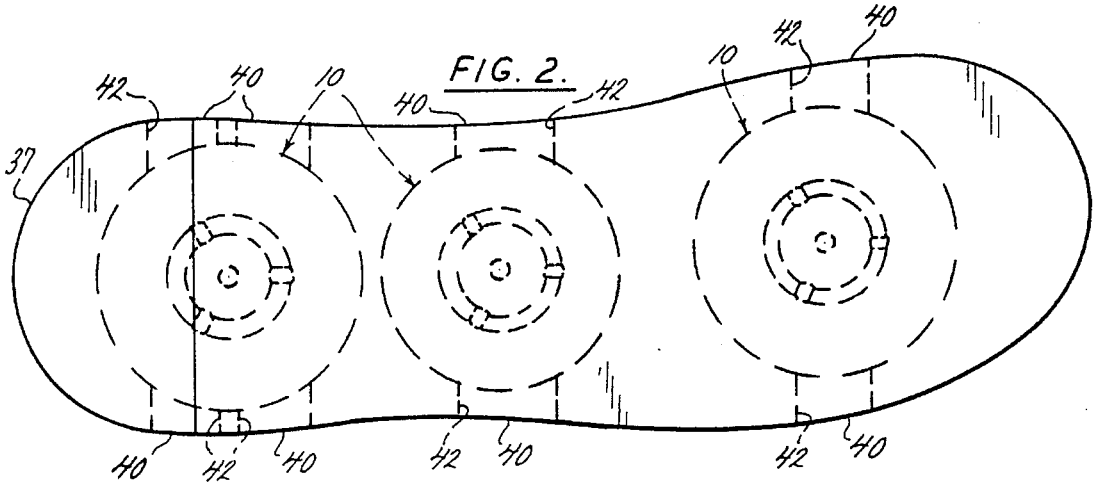
FIG. 3.
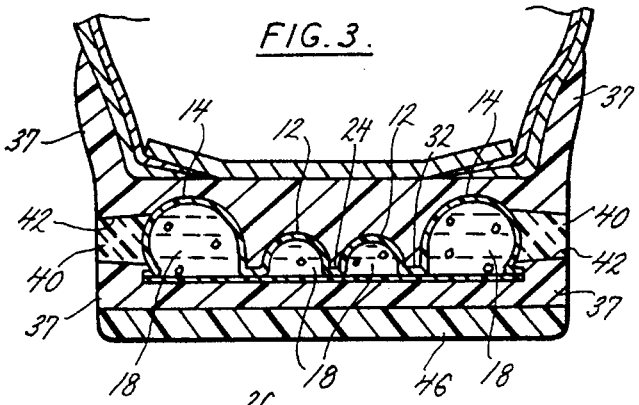
FIG. 6.
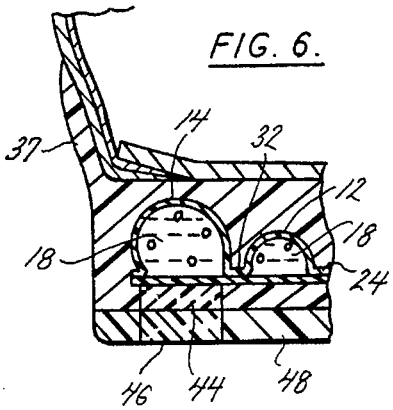
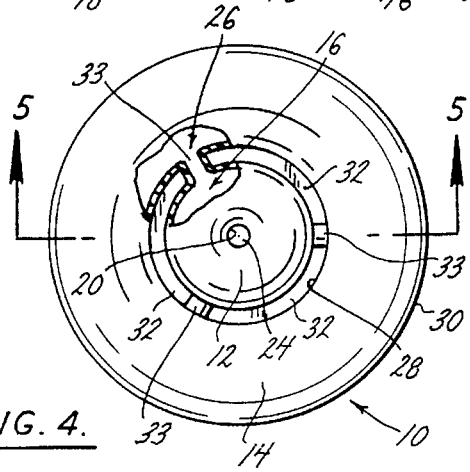
FIG. 4.
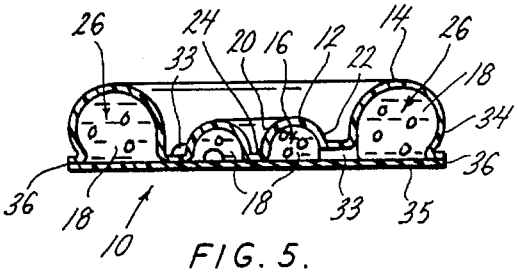
FIG. 5.

SHOE SOLE WITH REACTIVE ENERGY FLUID FILLED TOROID APPARATUS

This is a continuation of application Ser. No. 07/767,132 filed on Sep. 27, 1991 now abandoned.

BACKGROUND OF THE INVENTION (1) Field of the Invention

The present invention relates to a shoe sole having a fluid filled apparatus which reacts with the stimulus of an outside force, hereinafter referred to as Reactive Energy Fluid Filled Toroid Apparatus, contained in its midsole. In particular, the present invention provides a shoe sole having a toroid apparatus comprising concentric fluid filled toroids contained in its midsole, the toroid apparatus providing cushioning and stability to the shoe sole.

(2) Description of the Related Art

Many soles of shoes, in particular athletic shoes, require a certain amount of cushioning to absorb the shock of footstep impact in walking, running and other activities, and thereby provide some protection to the shoe wearer's foot. This is most evident in the heels of many athletic shoes, the heel portion of the shoe sole typically being the first portion of the sole to impact with the ground during running. To a somewhat lesser extent, cushioning is also required in the arch and forefoot areas of shoe soles. However, merely adding additional cushioning to the heel of a shoe sole has been found to be insufficient to protect the foot in several respects.

In running, the initial impact of a shoe sole on each footstep is typically along the outer, lateral edge of the runner's heel. As the cushioning of the shoe sole heel gives under the force of the footstep impact, the force of impact is concentrated on the lateral edge of the runner's heel and is not distributed over the entire heel surface. The initial impact on the outer edge of the runner's heel also tends to cause the rotation of the foot relative to the leg, or a lowering of the medial margin of the foot, commonly known as pronation. Excessive pronation is thought to be related to many different injuries of the foot.

During walking, running or other activities it is also possible that initial impact on the lateral border of the shoe sole will be followed by supination of the foot or the raising of the medial margin of the foot. As the shoe cushioning gives under impact, the force of impact is concentrated on the lateral edge of the heel and is not distributed over the heel surface. Excessive supination of the foot is commonly thought to be related to different injuries of the foot and ankle.

What is needed to overcome the above-described disadvantages of prior art athletic shoes is an apparatus that cushions the sole of the shoe, causing the forces due to each footstep impact to be distributed over a greater area of the foot than just the lateral or medial edges of the foot. What is also needed to overcome the above-described disadvantages is an apparatus in a shoe sole that stabilizes the foot in the shoe and reduces the tendency of the runner's ankle to bend in pronation or supination with each footstep impact.

SUMMARY OF THE INVENTION

The present invention overcomes the above-described disadvantages associated with prior art shoe soles by providing a shoe sole comprising a reactive energy cushioning and stabilizing apparatus. The preferred embodiment of the invention is generally comprised of a shoe sole having a midsole with a fluid filled toroid apparatus of the present invention molded or positioned in the heel area of the midsole.

The fluid filled toroid apparatus is comprised of two concentric fluid filled toroids. A smaller one of the two toroids is positioned at the center of the apparatus, and a second larger toroid completely surrounds the smaller toroid. The toroids are each constructed of a flexible plastic material, and the interiors of the two toroids are filled with a composite fluid. The composite fluid could include two fluids having different viscosities or the fluid could include solids, including but not limited to a sponge like foam or small hollow spheres or particles suspended in the fluid.

The smaller toroid is connected in fluid communication with the larger toroid by a plurality of fluid conduits that extend between the two toroids. The fluid conduits are configured to enable the passage of the composite fluid, including the hollow spheres or particles of the toroid fluid, through the conduits between the two toroids.

The shoe sole of the present invention is similar to conventional running shoe soles except that it is provided with the fluid filled toroid apparatus in the heel area of the midsole. In variant embodiments of the invention the toroid apparatus is also provided in the arch and/or forefoot areas of the midsole. The toroid apparatus may be encapsulated in the midsole as the midsole is molded, or may be inserted into a cavity molded in the midsole specifically for the toroid apparatus.

The fluid filled toroid apparatus contained in the midsole serves to cushion the shock exerted on the heel at each footstep impact. The ability of the toroid fluid to flow through the fluid conduits between the two toroids also serves to distribute the shock of footstep impact over a greater area of the runner's heel, and thereby reduce the shock of impact and the likelihood of excessive pronation or supination. The configuration of the toroid apparatus, with the smaller toroid in the center and the larger toroid on the outside, provides increased stability and support by cradling the heel in the shoe sole and also provides a custom fit of the foot heel on the shoe sole.

In variant embodiments of the invention, optical windows are provided in the outside of the shoe midsole and through the bottom of the shoe outsole. The windows enable the fluid filled toroid apparatus contained in the midsole to be seen from outside the shoe sole. In additional variant embodiments, additional fluid filled toroid inserts are provided in the shoe midsole in the areas of the ball of the foot and the arch of the foot.

BRIEF DESCRIPTION OF THE DRAWINGS

Further objects and features of the present invention are revealed in the following detailed description of the preferred embodiments of the invention and in the drawing figures wherein:

FIG. 1 is a partial elevation view of a shoe comprising a midsole containing the reactive energy fluid filled toroid apparatus of the present invention;

FIG. 2 is a plan view of the shoe bottom showing the placement of the fluid filled toroid apparatus of the present invention in the midsole of the shoe;

FIG. 3 is a partial elevation view in section showing the placement of the fluid filled toroid apparatus of the present invention in the heel area of the shoe midsole;

FIG. 4 is a plan view of the fluid filled toroid apparatus;

FIG. 5 is a cross section of the fluid filled toroid apparatus taken along the line 5—5 of FIG. 4; and FIG. 6 is a partial elevation view, in section, of a variant embodiment of the midsole containing the fluid filled toroid apparatus of the invention.

DESCRIPTION OF THE PREFERRED EMBODIMENT

The Reactive Energy Fluid Filled Toroid Apparatus 10 of the present invention is shown in FIGS. 4 and 5 of the drawing figures. The toroid apparatus is constructed from a flexible, barrier material, preferably a plastic type film that is capable of being bonded. Although polyurethane is preferred, other types of flexible, barrier materials may be employed in constructing the fluid tight apparatus of the invention without departing from the intended scope of the claims.

As seen in FIGS. 4 and 5, the toroid apparatus 10 of the present invention is generally comprised of an inner, smaller toroid 12 and an outer, larger toroid 14.

The smaller toroid 12 contains a hollow, annular interior chamber 16 filled with a fluid 18. The exterior configuration of the toroid 12 is defined by an inner perimeter wall 20 of the toroid and an outer perimeter wall 22. The center hole of the smaller toroid 12 is covered over by a web 24 of the flexible material employed in constructing the toroid apparatus.

The larger toroid 14 completely surrounds and is concentric to the smaller toroid 12. The larger toroid 14 also contains a hollow, annular interior chamber 26. The larger toroid chamber 26 is also filled with the same fluid 18 filling the interior chamber 16 of the smaller toroid 12. The exterior configuration of the toroid 14 is defined by an inner perimeter wall 28 of the toroid and an outer perimeter wall 30 of the toroid.

Web sections 32 are formed between the outer perimeter wall 22 of the smaller toroid 12 and the inner perimeter wall 28 of the larger toroid 14. The web sections 32 secure the two toroids 12, 14 together in their relative positions shown in the drawing figures. The web sections 32 are formed from the same flexible material employed in constructing the toroid apparatus.

Three fluid conducting conduits 33 extend between the outer perimeter wall 22 of the smaller toroid 12 and the inner perimeter wall 28 of the larger toroid 14. The fluid conduits 33 communicate with the interior chambers 16, 26 of the two toroids 12, 14 and enable the fluid 18 to flow between the toroid interior chambers through the conduits. As seen in drawing FIG. 4, the fluid conduits 33 are arranged in a spoke-like manner between the two toroids, separating the arcuate web sections 32.

The center web section 24, the smaller toroid 12, the fluid conduits 33 and the arcuate web sections 32, and the larger toroid 14 are all substantially co-planar as is shown in FIG. 5.

The toroid apparatus 10 is formed from a pair of overlapping sheets of the flexible, fluid tight material. As shown in FIG. 5, the upper sheet 34 has the concentric toroid configuration molded into it. The upper sheet 34 is laid over the bottom sheet 35 and is bonded to the bottom sheet. The sheets are bonded together along a perimeter seam 36 extending around the outside of the larger toroid 14, at the arcuate web sections 32 between the smaller 12 and larger toroid 14, and at the center web 24 of the smaller toroid. As the top and bottom are welded together along the arcuate sections 32, intervals between the adjacent sections are not bonded, thereby forming the fluid conduits 33 that communicate the smaller toroid interior chamber 16 with the larger toroid interior chamber 26. After the toroid apparatus is constructed in the manner described, the interior chambers of the two toroids are filled with the composite fluid 18. The composite fluid could include two fluids having different viscosities or the fluid could include solids including, but not limited to, a sponge like foam or small hollow spheres or particles suspended in the fluid. The above-described method of constructing the toroid apparatus of the invention 10 is illustrative only and is not intended to be limiting.

In the preferred embodiment of the invention, the fluid filled toroid apparatus 10 is contained in the midsole 37 of a shoe as shown in FIGS. 1–3 and 6. In FIG. 3, the toroid apparatus 10 is shown completely encapsulated in the midsole. The toroid apparatus is contained in the midsole 37 in the position shown in FIG. 3 by molding the midsole around the apparatus.

In variant embodiments, a cavity can be formed extending into the midsole from the top or bottom surfaces of the midsole, and the toroid apparatus 10 can be placed inside the cavity. After the toroid apparatus is inserted into the cavity, the opening of the cavity in the top or bottom surfaces of the midsole can be sealed shut by the insertion and adhesion of a plug in the cavity opening, the plug being constructed of the same material as the midsole.

Although the functioning of toroid apparatus 10 positioned beneath the heel in the midsole 37 of the shoe will be described, the apparatus may also be employed in the arch and forefoot areas of the shoe as is shown in FIGS. 1 and 2 or in other areas of the shoe sole. The toroid apparatus is constructed in the arch and forefoot areas of the midsole in the same manner as described in the heel of the midsole, and the toroid apparatus functions in the same manner in the arch and forefoot areas as it does in the heel area of the midsole.

The Reactive Energy Fluid Filled Toroid Apparatus 10 of the present invention, when assembled in the midsole of a shoe, cushions the foot of the shoe wearer and stabilizes the foot in the shoe during walking, running and other activities. From the above description of the toroid apparatus 10, it should be apparent that the apparatus functions as a fluid filled cushion in use in a shoe sole. However, the concentric toroid configuration of the apparatus also enhances its ability to provide a stabilizing, reactive force to the bottom of the foot in response to footstep impacts during walking, running or other activities. In the embodiment of the invention shown in FIG. 3 with the toroid apparatus constructed in the heel of a shoe midsole, as an impact force is exerted on the medial side of the shoe sole, or the right side of the sole as viewed in FIG. 3, the right side of the toroid apparatus will compress forcing the fluid 18 contained in the apparatus to move to the left sides of the concentric toroids 12, 14. This will cause the fluid pressure to increase on the left sides of the toroids and will cause the left sides of the toroids 12, 14 to expand slightly, exerting a reactive force against the left side of the foot bottom and redistributing the force of impact over a greater area of the foot heel. Should the footstep impact occur at the outside or lateral side of the foot, the force exerted on the left side of the shoe sole as viewed in FIG. 3 will cause the left sides of the toroids 12, 14 to compress. This, in turn, will cause the fluid contained at the left side of the toroids 12, 14 to flow to the right sides of the toroids, causing the fluid pressure to increase on the right sides of the toroids and causing the toroid right sides to expand. This expansion at the right sides of the two toroids 12, 14 will exert a reactive force in a direction against the right side of the foot bottom and redistribute the force of impact over a greater area of the foot heel. By distributing the force of footstep impact occurring at the edges of the shoe sole over an increased area of the foot heel, the toroid apparatus of the invention serves to stabilize and support the foot in its reaction to the off-center footstep impact, and thereby reduces the potential for injury.

As seen in FIG. 3, the relative sizes of the smaller 12 and larger 14 toroids form a recessed area in the center of the apparatus. This recessed area in the apparatus center provides stability and support by cradling the heel of the shoe wearer. In addition, the manner in which the larger toroid 14 extends above the smaller toroid 12 adjacent the opposite sidewalls of the midsole 37 serves to provide increased lateral stability to the midsole. The larger toroid 14, being adjacent the outer edges of the midsole 36 provides some resistance to the compression of the midsole at its opposite medial and lateral sides. This serves to increase the lateral stability of the midsole and reduces the likelihood of excessive pronation or supination from off-center footstep impacts.

Although the functioning of the toroid apparatus of the invention in the heel section of a shoe midsole is described above, the cushioning, stabilizing and support functions of the toroid apparatus are similar when the apparatus is employed in the arch or forefoot areas of the midsole.

In a variant embodiment of the shoe sole with the Reactive Energy Fluid Filled Toroid Apparatus of the present invention, the midsole is provided with several apertures that enable viewing the fluid filled toroid apparatus 10 contained in the midsole from outside the midsole. The midsole 37 is molded with a plurality of apertures 42 extending into the midsole from its sides. The apertures 42 are so positioned to extend into the midsole in the areas of the midsole containing the fluid filled toroid apparatus 10. A plastic holder 40 is then inserted and adhered in the apertures 42 to enable viewing of the toroid apparatus 10 from the outside of the midsole.

In a still further variant embodiment, an opaque or transparent holder 42 is inserted above the outsole 46 and a second transparent or opaque holder 44 is inserted into a cavity provided in the outsole 48 to provide a window in the bottom of the shoe sole enabling viewing the fluid filled toroid apparatus 10 contained inside the midsole.

In each of the embodiments of the midsole of the invention incorporating apertures, the toroid apparatus 10 is constructed of transparent materials enabling the composite fluid contained in the apparatus to be viewed from outside the shoe sole through the transparent windows.

While the present invention has been described by reference to a specific embodiment, it should be understood that modifications and variations of the invention may be constructed without departing from the scope of the invention defined in the following claims.

What is claimed is:

1. A cushioning, stabilizing and supporting apparatus for a foot, the apparatus comprising:

a shoe sole;

a fluid bladder positioned on a surface of the shoe sole, the bladder having a hollow inner chamber containing a fluid, the inner chamber having a flexible top surface that extends to a first vertical height above the surface of the shoe sole, the bladder having a hollow outer chamber containing a fluid, the outer chamber extends around the inner chamber on the surface of the shoe sole, the outer chamber having a flexible top surface that extends to a second vertical height above the surface of the shoe sole and above the first vertical height of the inner chamber top surface, the top surfaces of the outer chamber and the inner chamber together forming a concave recessed area above the center of the bladder that provides stability and support to the foot by cradling the foot in the recessed area;

a plurality of conduits containing fluid extending between the inner chamber and the outer chamber and connecting the inner and outer chambers in fluid communication;

the top surface of the inner chamber and the top surface of the outer chamber being separated by a plurality of arcuate webs that do not contain fluid and are recessed below and positioned between the inner and outer chambers and between the plurality of conduits.

2. The apparatus of claim 26, wherein:

the inner chamber, the outer chamber and the conduits are all fluid tight.

3. The apparatus of claim 1, wherein:

the outer chamber is shaped as a toroid.

4. The apparatus of claim 1, wherein:

the inner chamber is shaped as a toroid and the outer chamber is shaped as a toroid, and the inner and outer chambers are concentric.

5. The apparatus of claim 4, wherein:

the inner chamber has a hole at the center of its toroidal shape where no fluid is contained.

6. A cushioning, stabilizing and supporting apparatus for a foot, the apparatus comprising:

a shoe sole;

a fluid bladder positioned on a surface of the shoe sole, the bladder having a hollow inner chamber containing a fluid, the inner chamber having a flexible top surface that extends to a first vertical height above the surface of the shoe sole, the bladder having a hollow outer chamber containing a fluid, the outer chamber extends around the inner chamber on the surface of the shoe sole, the outer chamber having a flexible top surface that extends to a second vertical height above the surface of the shoe sole and above the first vertical height of the inner chamber rod surface, the top surfaces of the outer chamber and the inner chamber together forming a concave recessed area above the center of the bladder that provides stability and support to the foot by cradling the foot in the recessed area;

the fluid being a composite fluid comprised of at least two different liquids having different viscosities.

7. A cushioning, stabilizing and supporting apparatus for a foot, the apparatus comprising:

a shoe sole;

a fluid bladder positioned on a surface of the shoe sole, the bladder having a hollow inner chamber containing a fluid, the inner chamber having a flexible top surface that extends to a first vertical height above the surface of the shoe sole, the bladder having a hollow outer chamber containing a fluid, the outer chamber extends around the inner chamber on the surface of the shoe sole, the outer chamber having a flexible top surface that extends to a second vertical height above the surface of the shoe sole and above the first vertical height of the inner chamber top surface, the top surfaces of the outer chamber and the inner chamber together forming a concave recessed area above the center of the bladder that provides stability and support to the foot by cradling the foot in the recessed area;

the fluid being a composite fluid comprised of a liquid with a plurality of resilient particles suspended therein.

8. A cushioning, stabilizing and supporting apparatus for a foot, the apparatus comprising:

a shoe sole having opposite left and right sides;

a fluid bladder positioned on a surface of the shoe sole, the bladder having a hollow inner chamber containing a fluid, the inner chamber having a flexible top surface, the bladder having a hollow outer chamber containing a fluid, the outer chamber extends entirely around the inner chamber on the surface of the shoe, the outer chamber having a flexible top surface having opposite left and right sides positioned adjacent the opposite left and right sides of the shoe sole;

a plurality of conduits containing fluid extending between the inner and outer chambers and connecting the inner and outer chambers in fluid communication;

a plurality of arcuate webs formed in the bladder between the conduits and between the inner chamber top surface and the outer chamber top surface;

the outer chamber having a toroidal configuration.

9. The apparatus of claim 8, wherein:

at least a portion of the entire top surface of the outer chamber is positioned vertically above the top surface of the inner chamber on the shoe sole and together with the top surface of the inner chamber forms a recessed depression for cradling the foot within the top surface of the outer chamber and above the top surface of the inner chamber.

10. The apparatus of claim 8, wherein:

at least a portion of the opposite left and right sides of the outer chamber top surface are positioned vertically above the inner chamber top surface from the shoe sole surface.

11. A cushioning, stabilizing and supporting apparatus for a foot, the apparatus comprising:

a shoe sole having opposite left and right sides;

a fluid bladder positioned on a surface of the shoe sole, the bladder having a hollow inner chamber containing a fluid, the inner chamber having a flexible top surface; the bladder having a hollow outer chamber containing a fluid, the outer chamber extends entirely around the inner chamber on the surface of the shoe, the outer chamber having a flexible top surface;

at least one conduit containing fluid extending between the inner and outer chambers and connecting the inner and outer chambers in fluid communication;

at least one arcuate web formed in the bladder separating the inner chamber top surface and the outer chamber top surface;

the inner chamber having a circular peripheral configuration and the outer chamber having a toroidal configuration;

the outer chamber top surface having opposite left and right sides that are positioned adjacent to the opposite left and right sides of the shoe sole, and the flexibility of the outer chamber top surface causing one of the left and right sides of the outer chamber top surface to expand above the inner chamber top surface in response to a force of footstep impact exerted on the other of the left and right sides of the outer chamber top surface, the expanding one of the left and right sides of the outer chamber top surface exerting a reactive force opposing the footstep impact force and reducing a tendency of ankle bending in pronation and supination.

12. The apparatus of claim 11, wherein:

the inner chamber has a toroidal configuration.

13. A cushioning, stabilizing and supporting apparatus for a foot, the apparatus comprising:

a shoe sole;

a fluid bladder positioned on a surface of the shoe sole, the bladder having a peripheral edge and a center, the bladder having a hollow inner chamber containing a fluid, the inner chamber having a toroidal configuration with a center hole and a flat center web positioned in the center hole, and a top surface of the inner chamber is positioned vertically above the center web on the shoe sole; the bladder having a hollow outer chamber containing a fluid, the outer chamber having a toroidal configuration that extends around and is concentric to the inner chamber on the shoe sole, and a top surface of the outer chamber is positioned vertically above the top surface of the inner chamber on the shoe sole, and the vertical positioning of the bladder above the surface of the shoe sole becomes progressively smaller as the bladder extends from its peripheral edge to its center.

14. The apparatus of claim 13, wherein:

a plurality of conduits containing fluid extend radially between the inner and outer chambers and connect the inner and outer chambers in fluid communication, and a plurality of arcuate webs extend around the inner chamber between the conduits and separate the inner chamber from the outer chamber.

15. The apparatus of claim 13, wherein:

the top surface of the outer chamber is flexible and has opposite left and right sides that are positioned adjacent opposite left and right sides of the shoe sole, and the flexibility of the outer chamber top surface causes one of the left and right sides of the outer chamber top surface to expand above the inner chamber top surface in response to a force of a footstep impact exerted on the other of the left and right sides of the outer chamber top surface, the expanding one of the left and right sides of the outer chamber top surface exerting a reactive force opposing the footstep impact force and reducing a tendency of ankle bending in pronation and supination.

* * * * *